US011092411B1

(12) United States Patent
Gauvin

(10) Patent No.: US 11,092,411 B1
(45) Date of Patent: Aug. 17, 2021

(54) ISOLATED PYROTECHNIC CABINET

(71) Applicant: Phillip C. Gauvin, East Haven, CT (US)

(72) Inventor: Phillip C. Gauvin, East Haven, CT (US)

(73) Assignee: Phillip C. Gauvin, East Haven, CT (US)

( * ) Notice: Subject to any disclaimer, the term of this patent is extended or adjusted under 35 U.S.C. 154(b) by 0 days.

(21) Appl. No.: 16/831,673

(22) Filed: Mar. 26, 2020

(51) Int. Cl.
*F42B 4/20* (2006.01)
*F42B 4/26* (2006.01)

(52) U.S. Cl.
CPC . *F42B 4/20* (2013.01); *F42B 4/26* (2013.01)

(58) Field of Classification Search
CPC ..... F42B 4/20
See application file for complete search history.

(56) References Cited

U.S. PATENT DOCUMENTS 10,648,782 B2 * 5/2020 Chen ..... F42B 4/18
10,852,105 B1 * 12/2020 Xiaowen ..... F42B 4/18
10,948,271 B1 * 3/2021 Xiaowen ..... F42B 4/20

FOREIGN PATENT DOCUMENTS

DE 202017003423 U1 * 8/2017 ..... F42B 39/30

* cited by examiner

*Primary Examiner* — Reginald S Tillman, Jr.
(74) *Attorney, Agent, or Firm* — Steven M. McHugh

(57) ABSTRACT

A Cold Spark Device (CSD) is provided and includes a CSD base, wherein the CSD base includes a CSD collector defining a collector cavity, wherein the CSD collector includes a collector top, collector sides and a collector bottom, the collector top defining a top opening, and wherein the collector bottom defines a first collector bottom opening and a second collector bottom opening, a CSD sparkling device, and a CSD display case, wherein the CSD base includes a base structure which defines a base cavity for containing the CSD sparkling device, wherein the base structure defines a base cavity opening communicated with the base cavity.

1 Claim, 10 Drawing Sheets

ISOLATED PYROTECHNIC CABINET

RELATED APPLICATIONS

This application claims priority to and benefit of the filing date of U.S. Provisional Patent Application Ser. No. 62/823,679, filed Mar. 26, 2019, the contents of which are incorporated by reference herein in its entirety.

FIELD OF THE INVENTION

The present invention relates generally to a pyrotechnic display and more particularly to an isolated 'cold' pyrotechnic display which is configured to provide entertainment while preventing ignition of material surrounding the display.

BACKGROUND OF THE INVENTION

Pyrotechnic displays are well known and have been used for entertainment purposes for many years. However, these displays are notorious for emitting hot embers or sparks that can ignite surrounding materials. This is undesirable because it can start fires in crowed venues that can easily get out of control thereby causing property damage and/or death. In fact, there have been several instances where pyrotechnic displays were found to be the cause of fires that killed or injured a large number of people.

SUMMARY OF THE INVENTION

A Cold Spark Device (CSD) is provided and includes a CSD base, wherein the CSD base includes a CSD collector defining a collector cavity, wherein the CSD collector includes a collector top, collector sides and a collector bottom, the collector top defining a top opening, and wherein the collector bottom defines a first collector bottom opening and a second collector bottom opening, a CSD sparkling device, and a CSD display case, wherein the CSD base includes a base structure which defines a base cavity for containing the CSD sparkling device, wherein the base structure defines a base cavity opening communicated with the base cavity.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several Figures.

DETAILED DESCRIPTION OF THE INVENTION

Figure 1A:
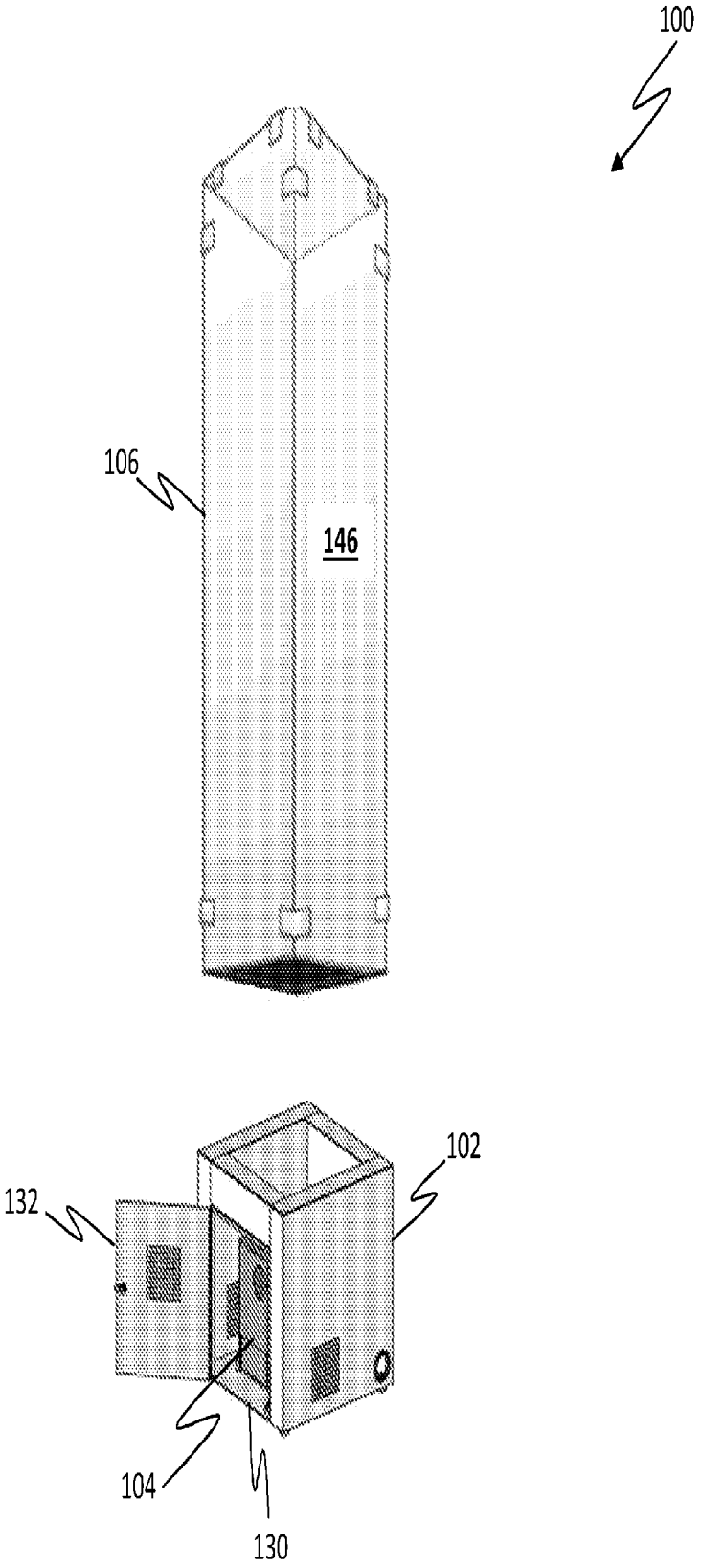
FIG. 1A is a side, perspective exploded view of a Cold Spark Device (CSD), in accordance with one embodiment of the invention.
Figure 1B:
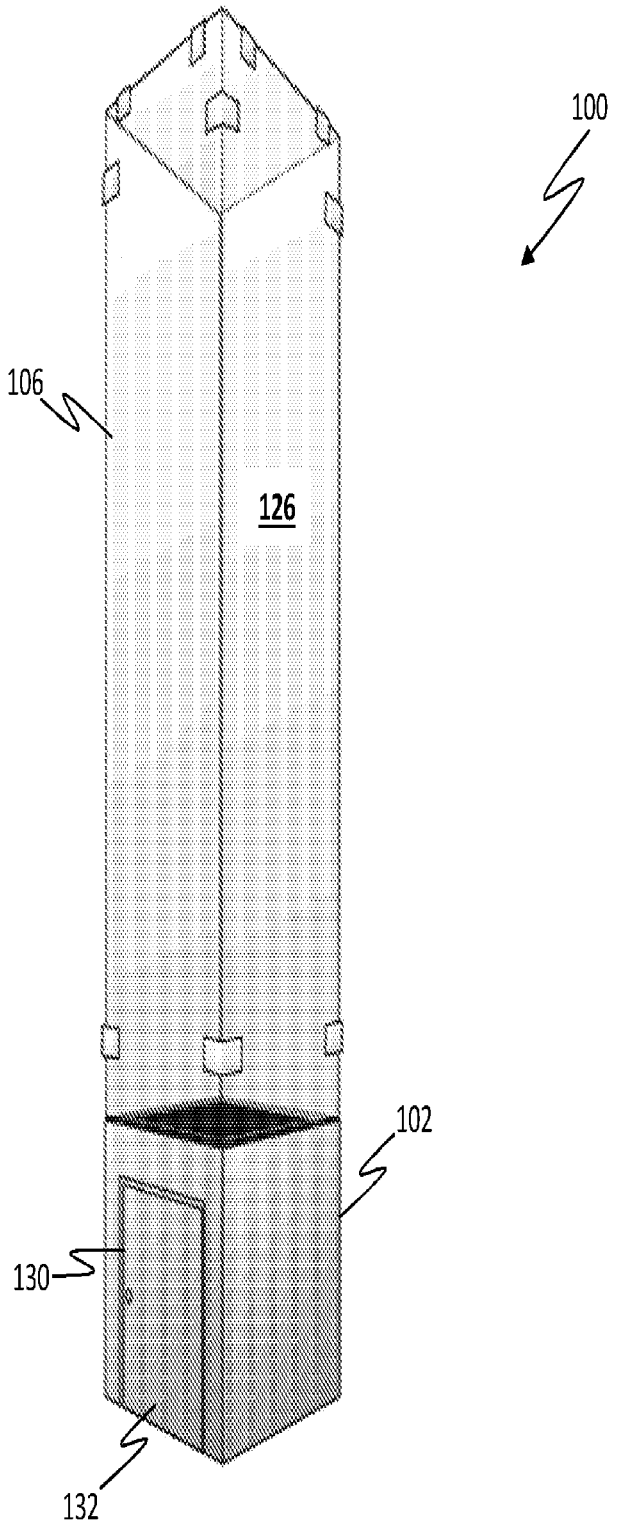
FIG. 1B is a side, perspective view of the Cold Spark Device (CSD) of FIG. 1A in its assembled form, in accordance with one embodiment of the invention
Figure 2:
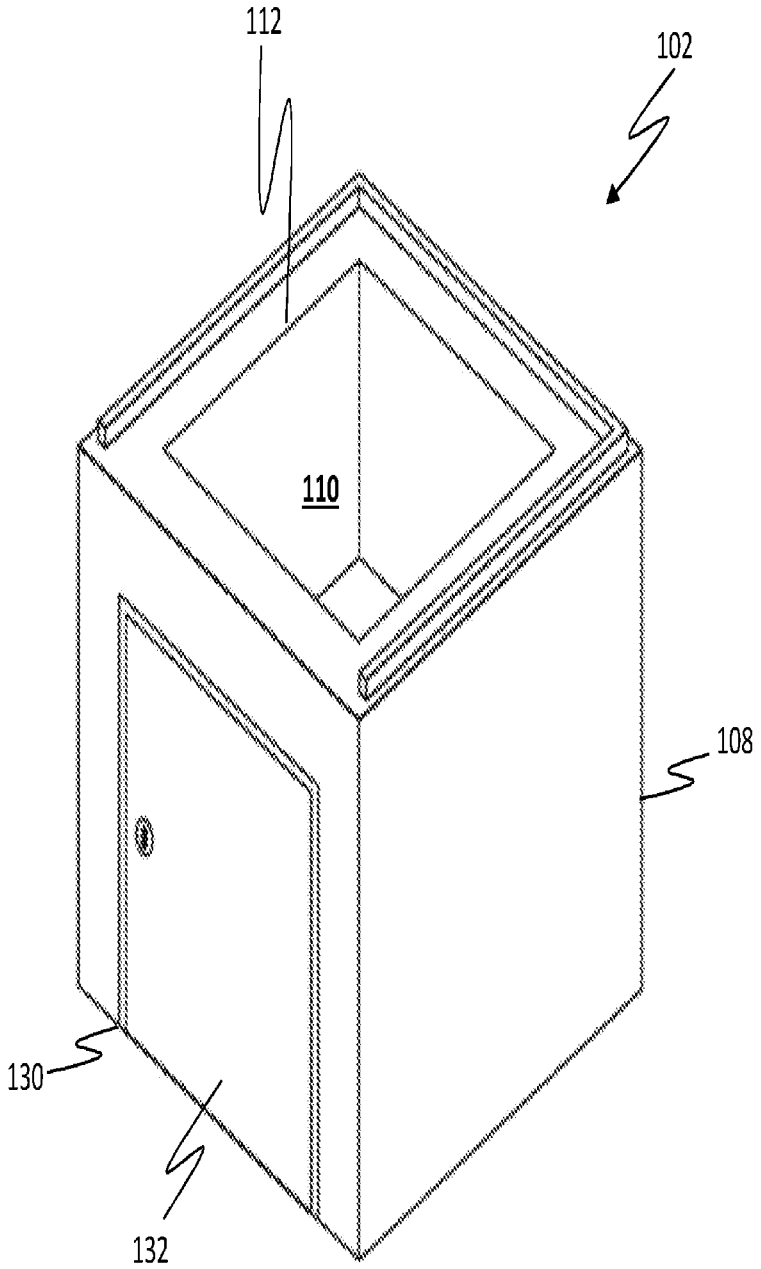
FIG. 2 is a top down, front side perspective view of a CSD base for use with the Cold Spark Device (CSD) of FIG. 1, in accordance with one embodiment of the invention.
Figure 3:
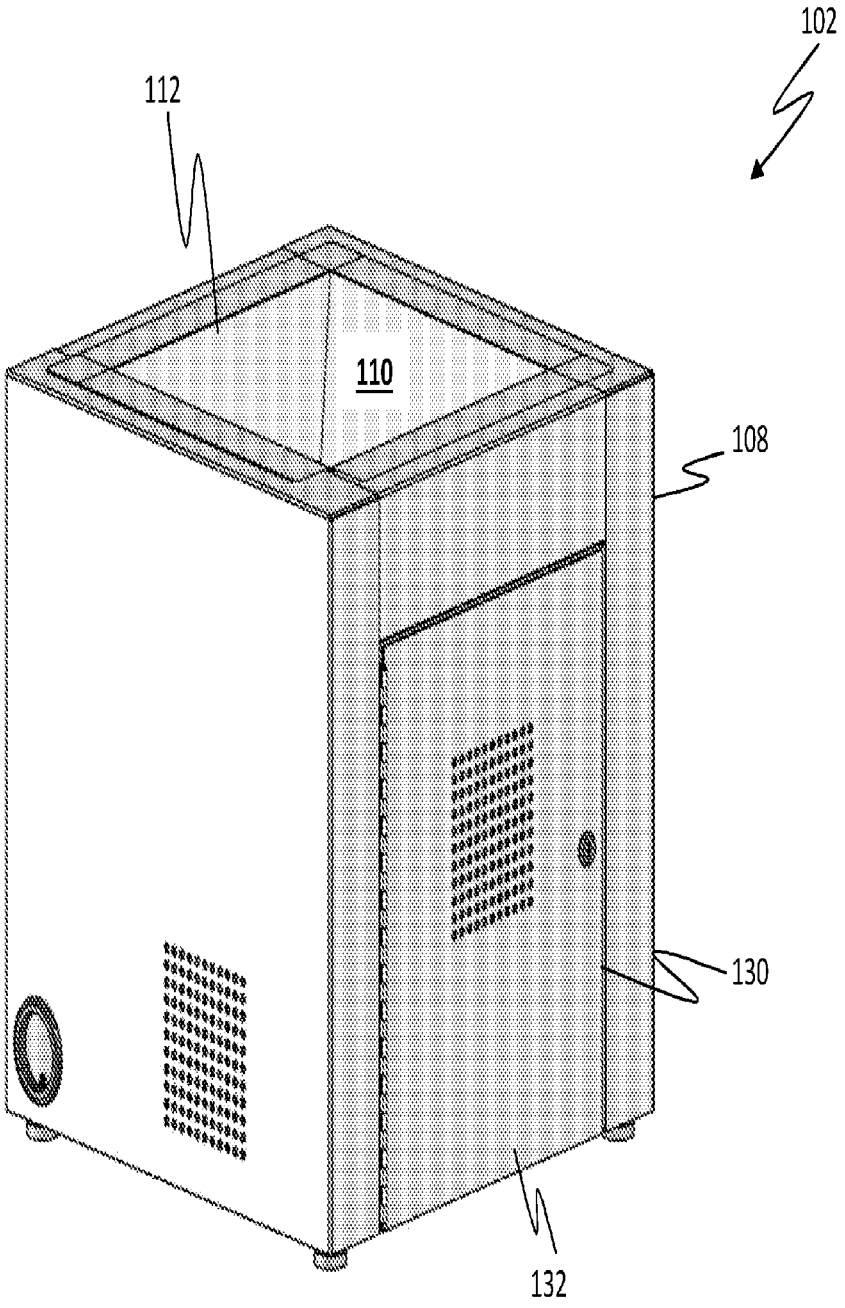
FIG. 3 is a front, side perspective view of a CSD base for use with the Cold Spark Device (CSD) of FIG. 1, in accordance with one embodiment of the invention.
Figure 4:
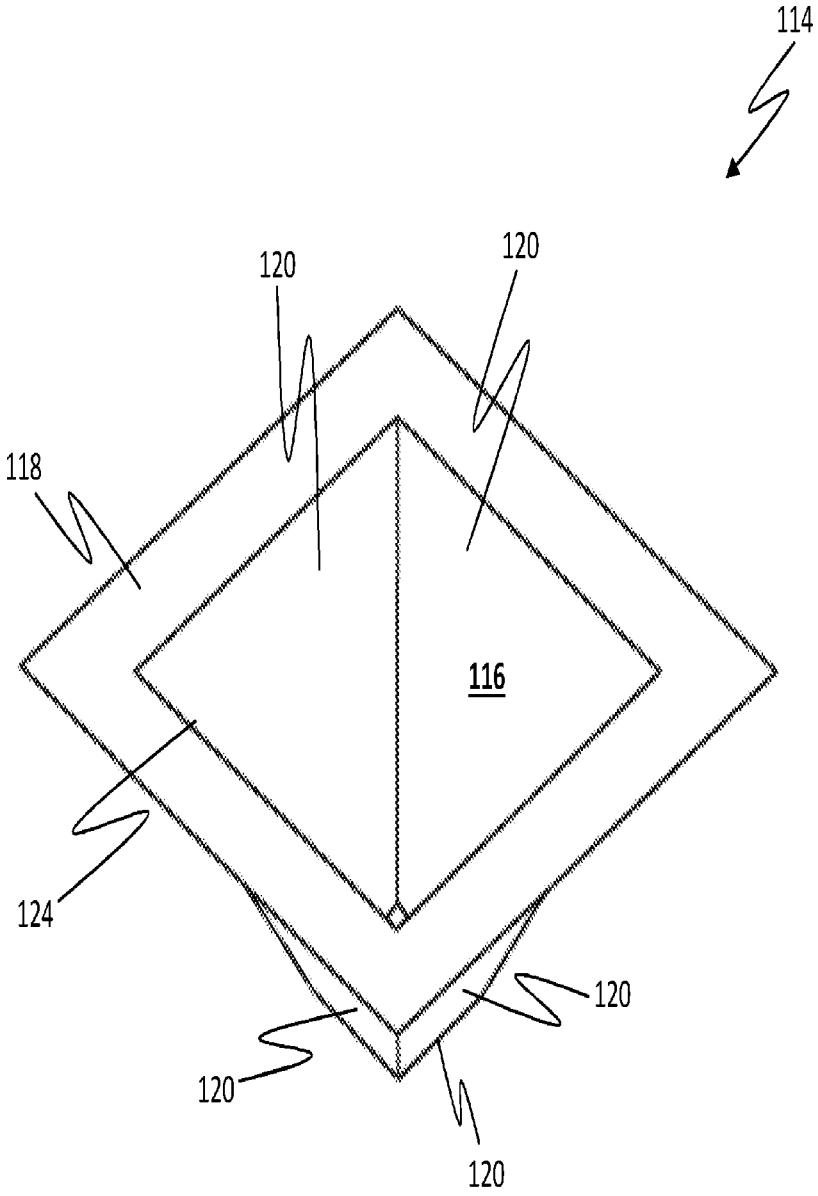
FIG. 4 is a top down, side perspective view of a CSD collector for use with the CSD base of FIG. 2, in accordance with one embodiment of the invention.
Figure 5:
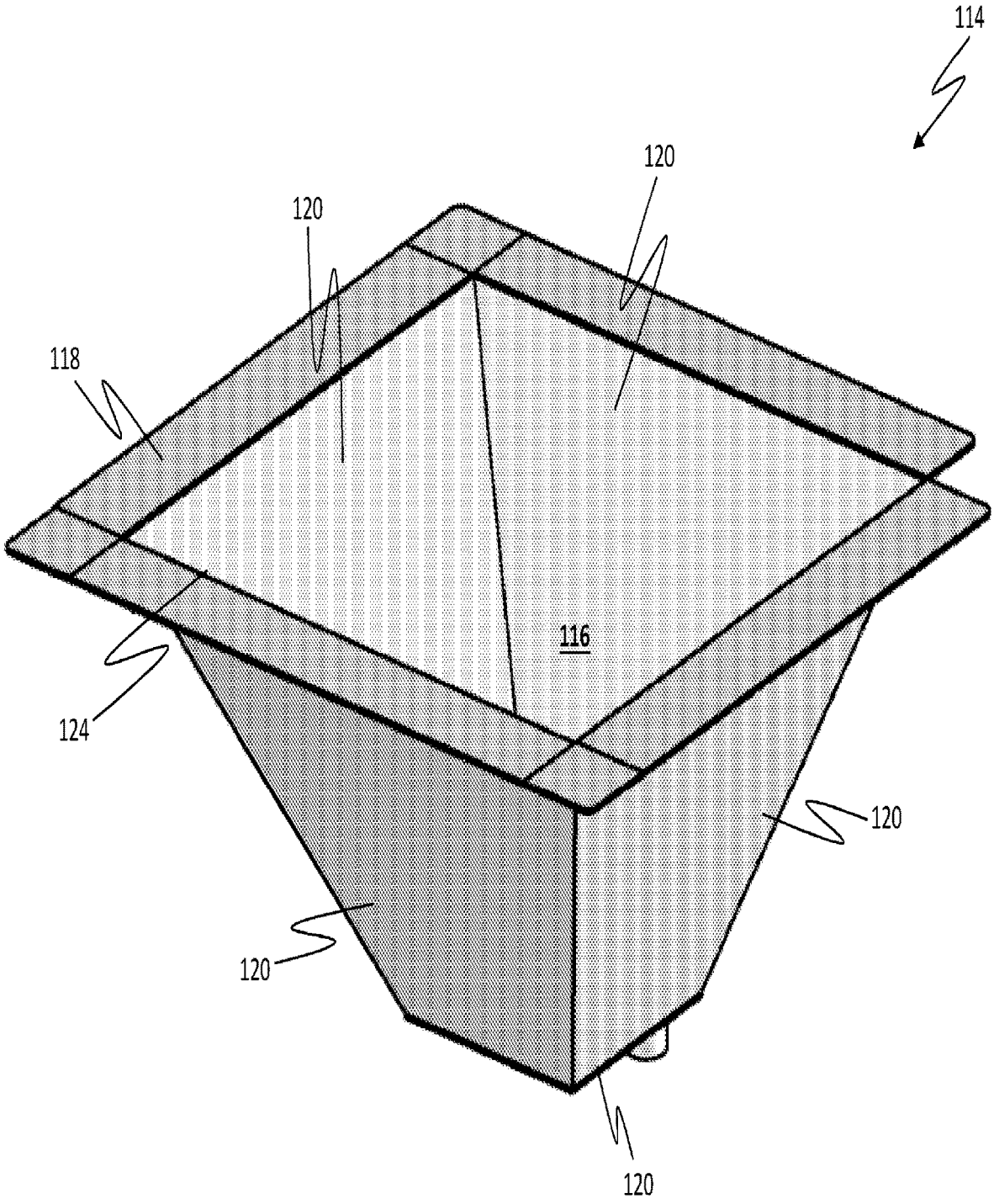
FIG. 5 is a top down, side perspective view of a CSD collector for use with the CSD base of FIG. 2, in accordance with one embodiment of the invention.
Figure 6:
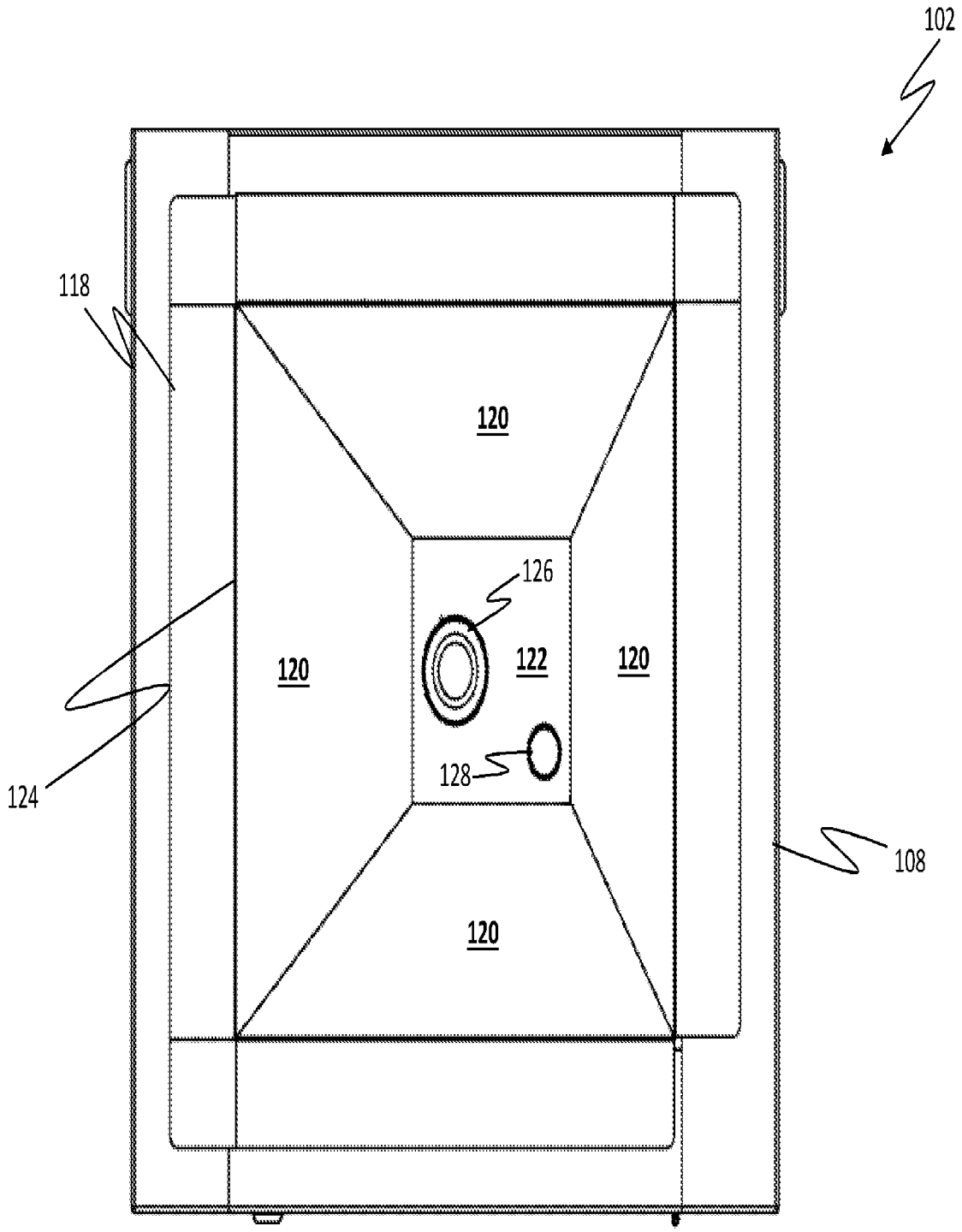
FIG. 6 is a top down view of the CSD base of FIG. 2 with a CSD collector installed within the CSD base, in accordance with one embodiment of the invention.
Figure 7:
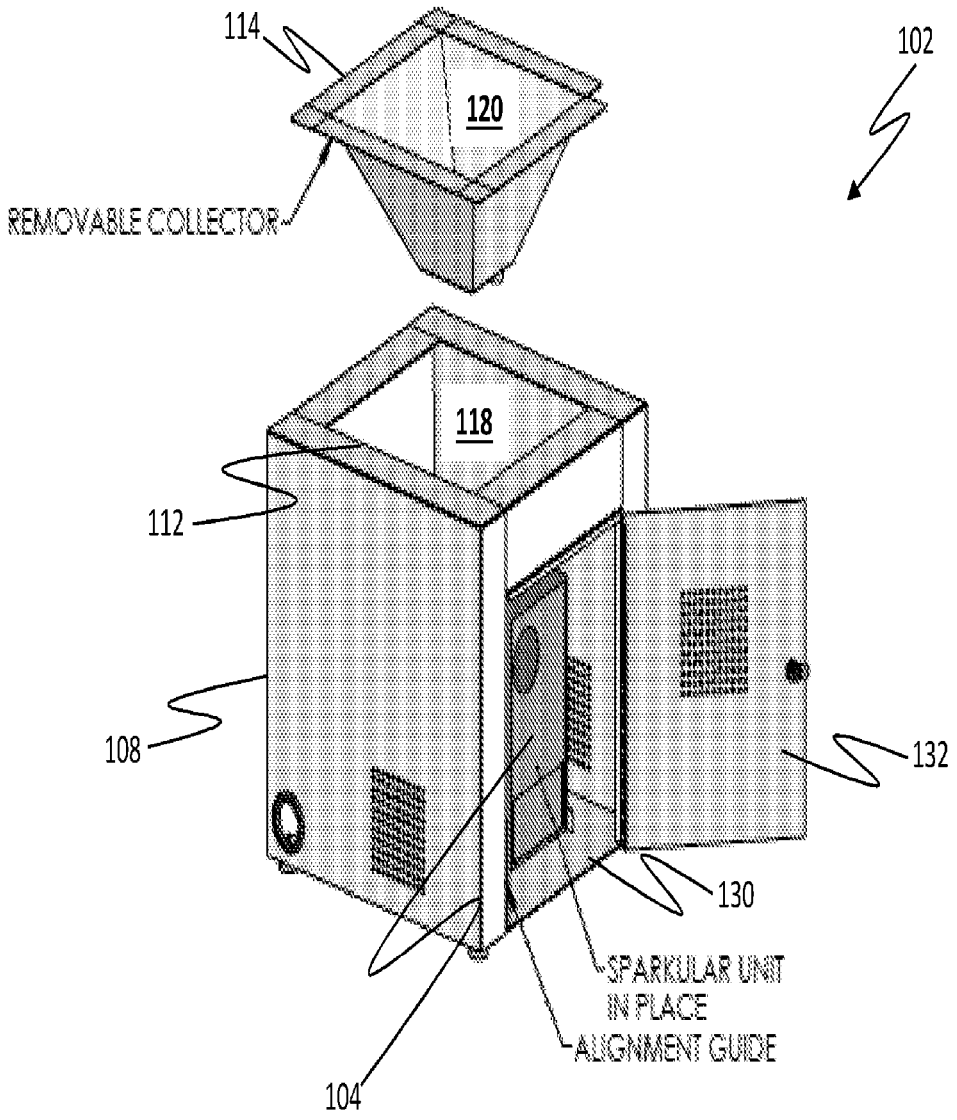
FIG. 7 is a top down, side perspective semi-exploded view of the CSD base of FIG. 2 for the Cold Spark Device (CSD) of FIG. 1, in accordance with one embodiment of the invention.
Figure 8:
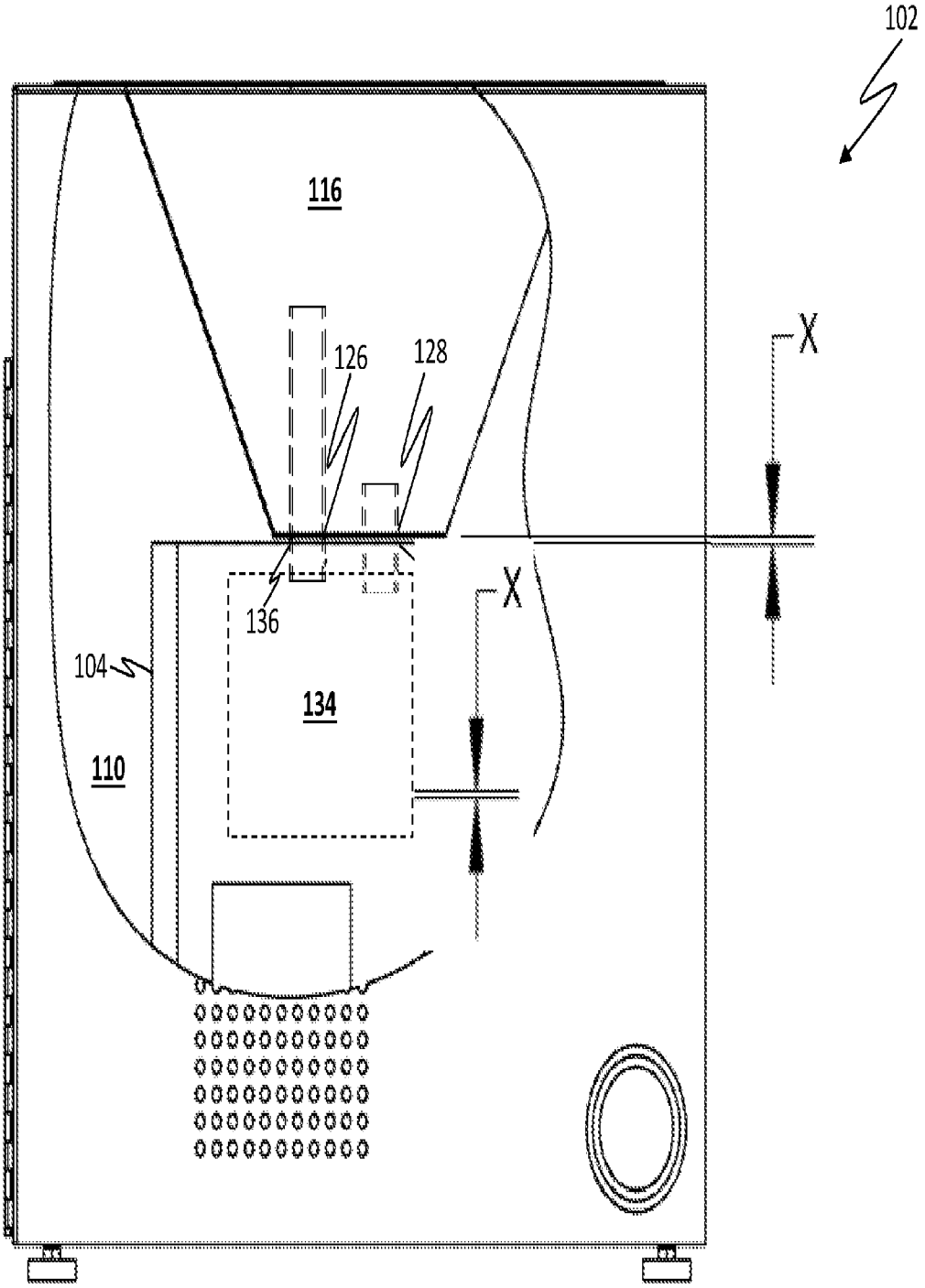
FIG. 8 is a side sectional view of a CSD base showing a sparking device located within the CSD base of FIG. 2, in accordance with one embodiment of the invention.
Figure 9:
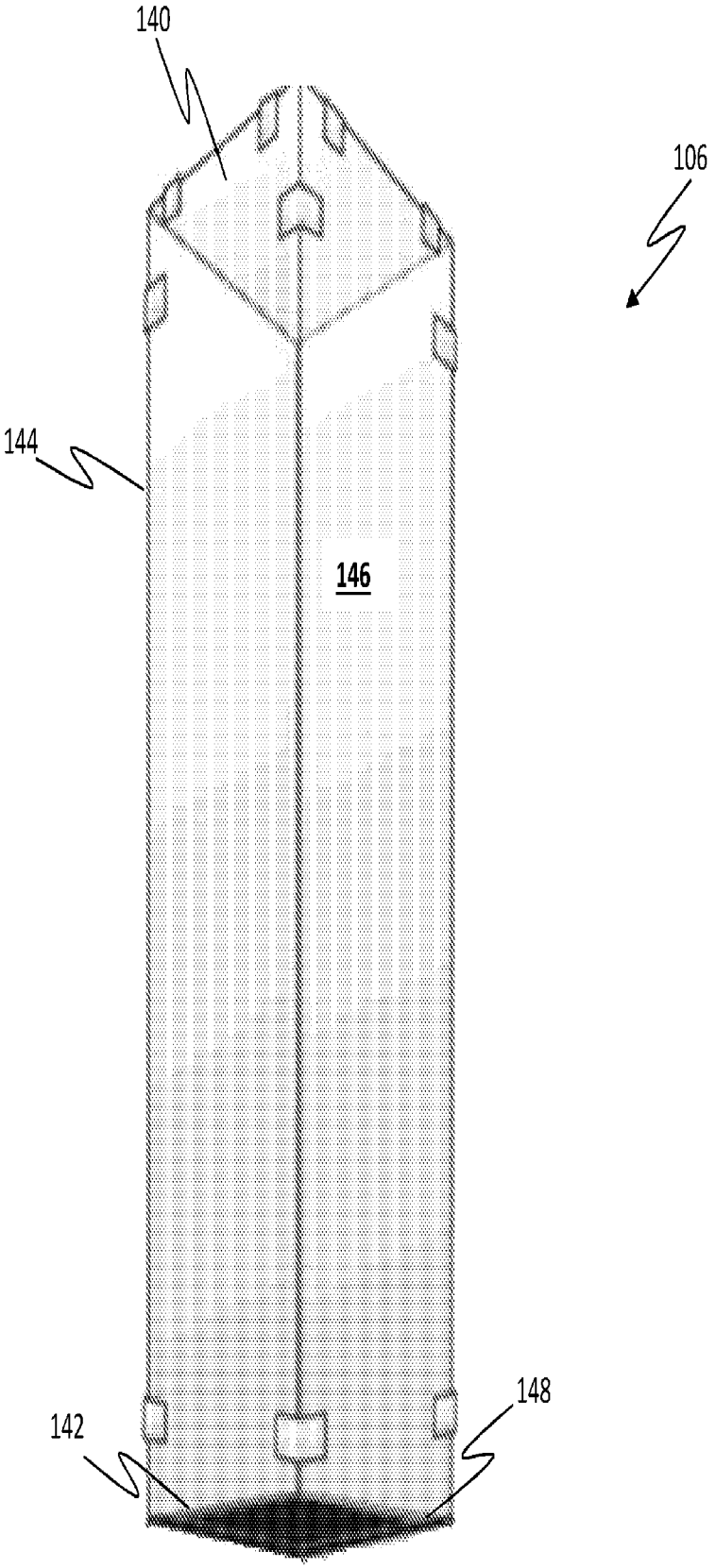
FIG. 9 is a side view of a CSD display case for use with the CSD base of FIG. 3, in accordance with one embodiment of the invention.

Referring to the FIG's. a Cold Spark Device (CSD) 100 is shown, in accordance with one embodiment of the invention and includes a CSD base 102, a CSD sparkling device 104 and a CSD display case 106, wherein the CSD base 102 includes a base structure 108 which defines a base cavity 110 for containing the CSD sparkling device 104, wherein the base structure defines a base cavity opening 112 communicated with the base cavity 110. The CSD base 102 further includes a CSD collector 114 defining a collector cavity 116, wherein the CSD collector 114 includes a collector top 118, collector sides 120 and a collector bottom 122, wherein the collector top 118 defines a top opening 124 and wherein the collector bottom 122 defines a first collector bottom opening 126 and a second collector bottom opening 128. It should be appreciated that the collector sides 120 extend between the collector bottom 122 and the collector top 118 and the collector bottom 122 is smaller than the collector top 118 such that the collector cavity 116 has an inverted 3-Dimensional trapezoidal shape. It should be appreciated that although one embodiment of the present invention is shown having a collector cavity 114 that has an inverted 3-Dimensional trapezoidal shape, other shapes may be used, such as a conical shape. Furthermore, the CSD collector 114 is configured to associate with the CSD base 102 to be located proximate the base cavity opening 112 and to extend downward into the base cavity 110, wherein the collector bottom 112 is located within the base cavity 110.

Base structure 102 further defines a base side opening 130 communicated with the base cavity 110 and includes a base side opening door 132, wherein the base side opening door 132 is configured to removably cover the base side opening 130 to allow and/or impede access to the base cavity 110. The CSD sparkling device 104 defines a sparkling device cavity 134 for containing a sparking substance that generates a 'cold spark' when ignited. The CSD sparkling device 104 defines a first sparkling device opening 136 and a second sparkling device opening 138, wherein the first sparkling device opening 136 and second sparkling device opening 138 are communicated with the sparkling device cavity 134, and thus the sparking substance. It should be appreciated that when the CSD sparkling device 104 is located within the base cavity 110, the first sparkling device opening 136 and/or second sparkling device opening 138 are located proximate to and communicated with the base cavity opening 112. The CSD display case 106 is at least partially constructed from a clear material (and/or semi-clear material, such as plastic, glass, etc.) and includes a case top 140, a case bottom 142 and a case wall 144 extending between the case bottom 142 and the case top 140, wherein the case bottom 142 defines a case bottom opening 148 and wherein the case top 140 and case wall 144 defines a case cavity 146. It should be appreciated that the case bottom opening 148 is communicated with the case cavity 146. It is contemplated that the CSD display case 106 may include facets which enhances the deflection of light produced by the cold spark thereby making the effect even more sparkling.

It should be appreciated that the CSD sparkling device 104, may be any device configured and capable of generating a cold spark such as for example, that which is produced and sold by Sparktacular Fireworks & Pyrotechnics of Jupiter Beach, Fla.

The CSD display case 106 is securely and removably associated with the CSD base 102 such that the case bottom opening 148 is proximate to and communicated with the case bottom opening 148. The CSD sparkling device 104 is located within the CSD base cavity 110 wherein the first sparkling device opening 136 and the second sparkling device opening 138 are located proximate to the base cavity opening 112. The CSD collector 114 is associated with the CSD base 102 to be located within the base cavity opening 112, wherein the first collector bottom opening 126 is communicated with the first sparkling device opening 136 and the second collector bottom opening 128 is communicated with the second sparkling device opening 138. Accordingly, when the CSD sparkling device 104 is operated to generate a 'cold spark' output 150, the 'cold spark' output 150 exits the first sparkling device opening 136, through the first collector bottom opening 126 and into the case cavity 146. It should be appreciated that to add more sparkling substance, the desired sparkling substance is introduced into the CSD sparkling device 104 via the second sparkling device opening 138. It should be further appreciated that there may be a small gap X, as desired, between the CSD collector 114 and the CSD sparkling device 104, such as, for example, a ⅛ inch gap.

It should be appreciated that although this invention is discussed herein as having only one sparkling device cavity 134, the CSD sparkling device 104 may include multiple sparkling device cavities 134 which may contain similar or different sparkling substances. For example, different sparkling substances may provide for different effects, such as color, brightness, etc. Additionally, it should be further appreciated that although this invention is discussed herein as having only one first sparkling device opening 136 for introducing the 'cold spark' into the case cavity 146, the CSD sparkling device 104 may have one or more additionally openings for introducing the 'cold spark' into the case cavity 146. Additionally, the although this invention is discussed herein as having only one second sparkling device opening 136 for introducing the sparkling substance into the sparkling device cavity 134, the CSD sparkling device 104 may have one or more additional openings for introducing the sparkling substance into one or more sparkling device cavities.

Furthermore, it is contemplated that the Cold Spark Device (CSD) 100 may include a processing device that is associated with the CSD sparkling device 104, which will allow the CSD sparkling device 104 to be operated using various configurations as desired and/or which will allow the CSD sparkling device 104 to be operated remotely and/or which will allow the CSD sparkling device 104 to be operated in conjunction with other devices, such as for example another CSD sparkling device 104 and/or music/lighting devices.

As described above, the methods and embodiments described hereinabove and in the several figures may be embodied in the form of computer-implemented processes and apparatuses for practicing those processes. The methods and embodiments described hereinabove and in the several figures may also be embodied in the form of computer program code containing instructions embodied in tangible media, such as floppy diskettes, CD-ROMs, hard drives, or any other computer-readable storage medium, wherein, when the computer program code is loaded into and executed by a processor; the processor becomes an apparatus for practicing the invention. Existing systems having reprogrammable storage (e.g., flash memory) may be updated to implement the invention. The methods and embodiments described hereinabove and in the several figures may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments may configure the microprocessor to create specific logic circuits. It should be further appreciated that the methods and embodiments described hereinabove may also be practiced, in whole or in part, via any device suitable to the desired end purpose, such as a computer, iPod, MP3 Player, a PDA, a Pocket PC and/or a Cell phone with connection capability.

It should be appreciated that all of the information contained herein may be combined together (individually or wholly) or taken singly to achieve varying embodiments of the invention and to add to the scope of the invention without limiting the invention to a particular embodiment. Moreover, additional information is provided in the attached appendix where the information does not and is not intended to limit the scope of the invention.

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A Cold Spark Device (CSD), comprising:

a CSD base, wherein the CSD base includes a CSD collector defining a collector cavity, wherein the CSD collector includes a collector top, collector sides and a collector bottom, the collector top defining a top opening, and wherein the collector bottom defines a first collector bottom opening and a second collector bottom opening, a CSD sparkling device, and a CSD display case, wherein the CSD base includes a base structure which defines a base cavity for containing the CSD sparkling device, wherein the base structure defines a base cavity opening communicated with the base cavity.

* * * * *